United States Patent [19]

Dent

[11] Patent Number: 4,617,888

[45] Date of Patent: Oct. 21, 1986

[54] PISTONS FOR INTERNAL COMBUSTION ENGINES

[75] Inventor: John C. Dent, Loughborough, England

[73] Assignee: National Research Development Corporation, London, England

[21] Appl. No.: 883,510

[22] Filed: Dec. 19, 1984

[30] Foreign Application Priority Data

Dec. 21, 1983 [GB] United Kingdom ..... 8334101

[51] Int. Cl.[4] ..... F02F 3/24

[52] U.S. Cl. ..... 123/307; 123/193 P; 123/659

[58] Field of Search ..... 123/193 R, 193 P, 307, 123/306, 659, 671

[56] References Cited

U.S. PATENT DOCUMENTS

| | | | |
|---|---|---|---|
| 1,708,428 | 4/1929 | Moore | 123/307 |
| 1,741,032 | 12/1929 | Minter | 123/659 |
| 2,269,084 | 1/1942 | McCarthy | 123/307 |
| 3,766,900 | 10/1973 | Aiti | 123/193 P |
| 3,919,982 | 11/1975 | Goto et al. | 123/193 P |
| 4,005,684 | 2/1977 | Habu | 123/193 P |
| 4,009,702 | 3/1977 | Mayer | 123/193 P |
| 4,170,966 | 10/1979 | Schmidt | 123/59 BS |
| 4,359,027 | 11/1982 | Scharpf | 123/307 |
| 4,471,734 | 9/1984 | Showalter | 123/307 |

FOREIGN PATENT DOCUMENTS

| | | |
|---|---|---|
| 0025831 | 7/1980 | European Pat. Off. . |
| 815580 | 10/1951 | Fed. Rep. of Germany . |
| 241529 | 9/1926 | United Kingdom . |
| 570968 | 7/1945 | United Kingdom . |
| 760860 | 11/1956 | United Kingdom . |
| 901982 | 7/1962 | United Kingdom . |
| 1563583 | 3/1980 | United Kingdom . |

*Primary Examiner*—Craig R. Feinberg

*Attorney, Agent, or Firm*—Cushman, Darby & Cushman

[57] ABSTRACT

A piston for use in the cylinders of internal combustion engines of either spark ignition or compression ignition type. A succession of interrupted ribs, aligned along arcs of increasing radius, stand proud of the piston crown surface to promote turbulence in the unburned charge as the flame spreads to meet them. The solid parts of all the ribs are preferably arranged in a regular pattern, and may be of such arcuate extent and so staggered from arc to arc that no sector of the flame can spread straight across the surface of the piston crown without being deflected by at least one solid part. The surface of the crown may be divided into upper and lower levels by a step, with ribs standing up from both levels.

13 Claims, 6 Drawing Figures

PISTONS FOR INTERNAL COMBUSTION ENGINES

This invention relates to the pistons of internal combustion engines. The use of in-cylinder turbulence to increase the mass burning rate of the charge of fuel and air is well known in the arts of both spark ignition and compression ignition engines. In a spark ignition engine, the use of a fast mass burning rate enables the ignition timing to be retarded, and hence the octane requirement of the engine to be reduced.

In known internal combustion engines generally it has been conventional practice to promote in-cylinder turbulence principally by attention to the geometry of the intake port and combustion chamber. In a compression ignition engine, the normal method by which the fuel is injected itself promotes turbulent mixing of the total charge of fuel and air, and the turbulence has been enhanced by forming the combustion chamber compactly in the piston or cylinder head. It will be appreciated that these conventional method of creating turbulent mixing are applied to the charge essentially before combustion has begun. In spark ignition engines, a similar approach has been adopted and in addition some proposals have been made to promote mixing by providing the piston crown with various forms of obstacle to the progress of flame across it. However these obstacles have often been in the form of grooves or other holes cut or formed in the crown surface. Such designs have the disadvantage not only of often being expensive to manufacture, but also of requiring a thicker crown than would otherwise be necessary in order to retain adequate strength and depth of remaining material once the holes have been cut. A weight penalty is therefore incurred. In other designs where the obstacles have stood up from the crown surface instead of being recessed within it, the obstacles have frequently been extensive and sometimes of complex shape, and no attention appears to have been given to the problem of heat loss that the structures have tended to impose, because of their considerable surface area.

The present invention arises from appreciating the potential of an obstacle of a simpler basic design yet with restricted surface area. The invention is a piston for use in a cylinder of an internal combustion engine of either spark ignition or compression ignition type, in which a succession of arcuately-aligned obstacles of increasing radius is formed on the piston crown to promote turbulence in the unburned charge as the flame meets them in succession from their concave sides as it spreads, and in which the obstacles are in the form of rub-like structures standing proud of the crown surface and each such structure is interrupted along its arc, comprising alternate structural elements and gaps.

The centres of curvature of the arcs preferably all lie in a plane including both the piston axis and the ignition axis—that is to say, the line parallel to the piston axis and passing through the spark (in a spark ignition engine) or the point of fuel injection (in a compression ignition engine). The centres of curvature may be coincident.

The structural elements and gaps in one arcuate rib may be staggered relative to those in an adjacent rib. The arcuate length of all gaps may be substantially the same, but alternatively or in addition the arcuate length of all structural elements may be substantially the same.

The structural elements may be arranged in a regular geometrical pattern, when viewed in a direction normal to the direction of spread of the flame, and the pattern may be one of diagonally-aligned, ir "diamond" type.

The structural elements may be of circular outline, when viewed in a directional normal to that of the spread of the flame; alternatively they may be of other outlines, including arcuate and rectangular, the longer sides of such rectangles being substantially aligned with the arc, when viewed in a direction normal to that of the spread of the flame. In this case the rectangular shape of the structural elements may be the same in all the ribs, and the arcuate length of the intervening gaps may be consistent within each arc but may increase with increasing arc radius. The structures of smallest radius may constitute complete circles.

The surface of the piston crown may be divided into upper and lower levels by a step, and the rib-like structures may be mounted on both the upper and the lower levels. The structures formed on the lower level may be taller than those formed on the upper, so that the crests of all the structures lie substantially in a common radial plane relative to the piston axis, and the step, like the structures, may be arc-shaped, the centre of curvature of that arc lying in a common plane with the centres of curvature of the arcuate structures.

The invention is further defined by the claims, the content of which is to be read as part of the disclosure of this specification and the invention will now be described, by way of example, with reference to the accompany diagrammatic drawings in which:

Figure 4:
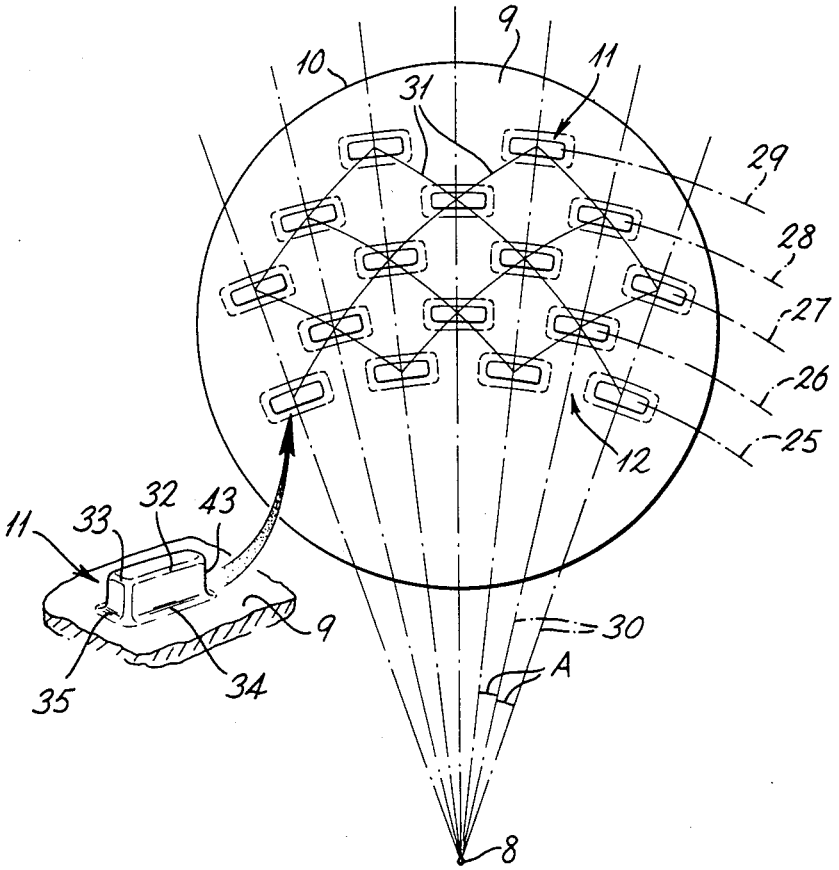

FIG. 4 including also a detail shown in perspective, and

Figure 5:
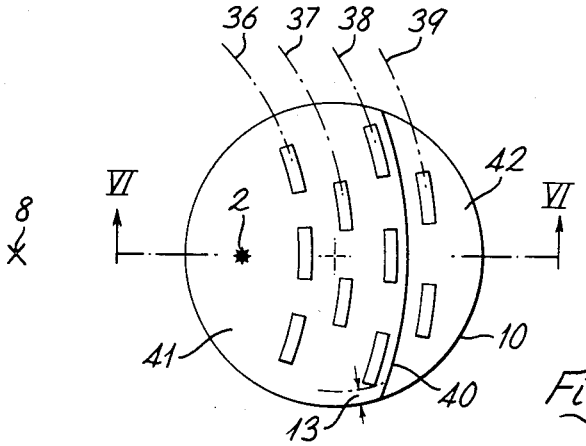
Figure 6:
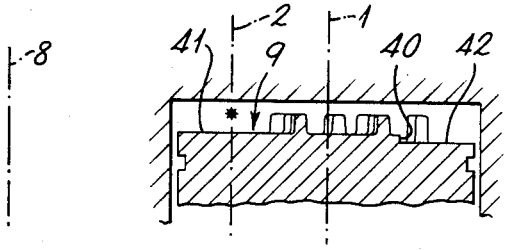

FIG. 6 is a section on the line VI—VI in FIG. 5.

Figure 1:
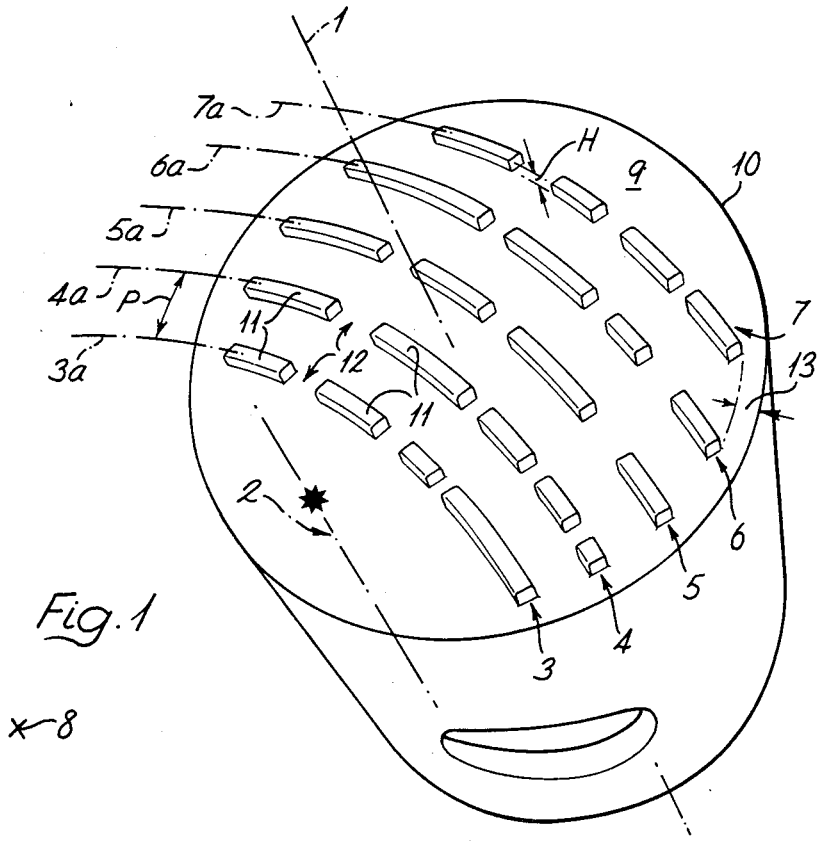
FIG. 1 is a perspective view from above of one piston.

FIG. 1 shows a piston for a spark ignition engine in which there is substantial displacement between the cylinder axis 1 and the parallel line 2—to be referred to as the ignition axis—passing through where the spark plug is mounted on the confronting surface of the cylinder head (not shown). In a compression ignition engine the ignition axis 2 would pass through the point where fuel is injected into the cylinder. Obstacles in the form of five ribs 3 to 7 are formed on the surface 9 of the crown, the ribs being aligned with five imaginary arcs 3*a* to 7*a* having a common centre 8 lying outside the cylinder on a line passing through axes 1 and 2. The height of each rib (measured parallel to axis 1) is H, the pitch between adjacent ribs (measured radially relative to centre 8) is P, and the distance (measured along axis 1) between the piston crown and the confronting surface of the cylinder head (not shown) at top dead centre is D. Tests suggest that where a piston as shown having five ribs (or even a maximum of one more) is used in an engine of compression ratio in the range 8.5 to 13, and the ignition timing is adjusted to give maximum torque, advantageous fuel mixing compared with a conventional obstacle-free design is obtained especially where the ratio H/D is in the range 0.4 to 0.6, the ratio P/H is in the range 3 to 6, and the distance of the smallest rib 3 from axis 2, measured radially relative to centre 8, is at least 6H. Each rib is of interrupted form, comprising alternate upstanding elements 11 separated by gaps 12. As shown in FIG. 1 the lengths (measured along their respective arcs) of the elements and gaps are somewhat random, but the following points should be specially noted. Firstly that the gaps in the entire series of ribs are staggered so that it is not possible for any substantial sector of flame, spreading across the crown surface 9 from the ignition axis 2, to pass straight across the surface without having to meet and be deflected by at least one of the elements 11. Secondly that the elements at the opposite ends of ribs 3 to 7 do not extend as far as the periphery 10 of the surface 9, but stop short of that periphery by a gap 13 which, measured radially relative to axis 1, lies within the range of said H to 2H. Thirdly that the shape of the elements 11 is essentially that of a rectangular block, the longest dimensions of each element lying substantially parallel to the tangent to the mid-point of that part of the arc on which the element lies.

Figure 2:
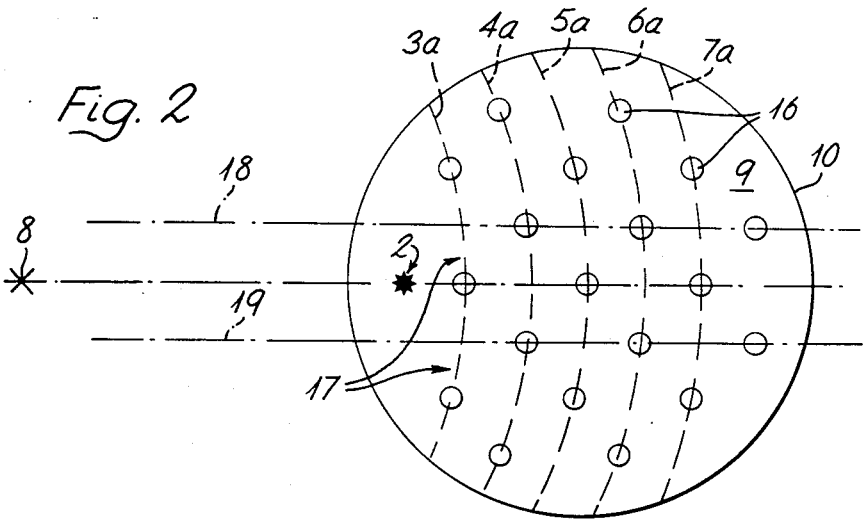
FIGS. 2 to 5 are plan views of four further pistons.

The rub-like obstacles aligned along the arcs 3*a* to 7*a* on the crown surface 9 of the piston of FIG. 2 still share a common centre of curvature 8, and the ignition axis 2 is located as before, but this construction differs from that of FIG. 1 in the following two respects in particular. Firstly that the structural element 16, instead of being substantially rectangular in plan like the elements 11, are now peg-like and therefore circular in plan. Secondly that they are arranged in a regular geometric pattern of diamond-like appearance. The spaces 17 between adjacent elements 16 are all equal, and another feature of the regular geometric pattern is that elements aligned along alternate arc are also aligned along imaginary axis 18, 19 etc., all of which axes lie parallel to the plane including the centre of curvature 8 and the ignition axis 2.

Figure 3:
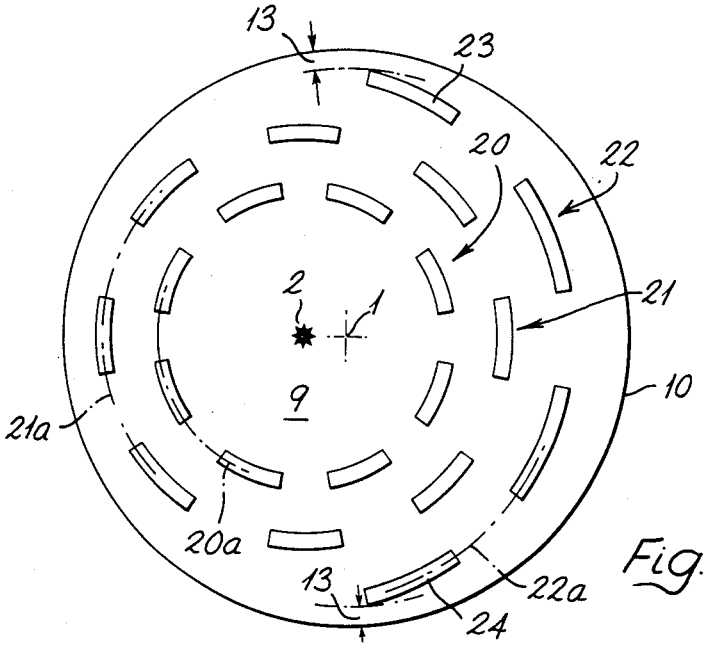

The piston of FIG. 3 is for a cylinder in which the ignition axis 2 is much closer to the cylinder axis 1, and with this configuration it may be desirable as shown for the centre of the three arcuate ribs to be coincident with axis 2. The ratios H/D and P/H will typically be as for the piston and cylinder of FIGS. 1 and 2, and the radius of the smallest rib 20 will again typically be of the order of 6H, with the result that the arcs 20*a*, 21*a* of ribs 20 and 21 are now complete circles and the arc 22*a* of the outer rib 22 is the only part-circular one. The elements 11 and gaps 12 are similar in shape to those of FIG. 1, but instead of the random arrangement of that Figure all the elements in each individual rib are now equal in length, this length increasing with radius so that all but two of the elements subtend the same angle at their centre which coincides with the ignition axis 2. The exceptions are the two end elements 23, 24 of the outer rib 22 which are cut short to allow a radially clearance of 2H from the periphery 10 of the piston, as in FIG. 1.

In the further design variation shown in FIG. 4 five ribs, aligned along five arcs 25–29 having the common centre of curvature 8 and separated by equal increments of radius, are mounted on the surface 9 of the piston crown. As in FIGS. 1 and 3 the elements 11 are essentially of rectangular shape when viewed in plan, but now they are of all of the same length and breadth and are arranged in a regular formation by being aligned both with their respective arcs and with imaginary radii 30 separated from each other by equal angles A. The pattern presented by the elements 11 when viewed as in the Figure is therefore essentially of "diamond" type but with some curvature to the sides of the diamond, as the imaginary loci 31 indicate. As in FIGS. 1 and 3, but not FIG. 2, the elements 11 and gaps 12 are staggered so that it is not possible for any substantial sector of flame spreading across the crown surface 9 from the ignition axis 2 to pass straight across the surface without being deflected by passing closely around at least one of the elements 11. The gaps 12 in arc 25 are thus a little shorter than the elements 11, but the gaps become progressively longer as the arc radii increase. A further advantageous feature illustrated by this Figure, and which could be applied with advantage to the designs of all the other Figures also, is that sharp corners are avoided. Sharp corners promote local "hot spots" and thus the danger of pre-ignition. As the detailed perspective view shows, not only are the longer and shorter top edges 32, 33 and the vertical corners 43 of the elements 11 rounded, to a typical radius of say one or two mm where the cylinder diameter is of the order of 80–90 mm, but also the corners 34, 35 where each element meets the surface 9 are similarly rounded.

The remaining design shown in FIGS. 5 and 6 shows ribs, with elements and gaps arranged much as shown in FIG. 4, aligned along four concentric arcs 36–39. However the piston surface 9 includes a step 40, which is also aligned with an arc drawn about centre 8, and which divides the piston surface into an upper level 41 and a lower level 42. The elements of the rib aligned with arc 39 and mounted on the lower level 42 are taller than the elements of the other three ribs, so that the crests of all the ribs lie in substantially the same radial plane relative to axis 1. The axial height of the step 40 will typically be of the same order as the height H of the elements mounted on the upper level 41, so that the elements aligned with arc 39 will therefore have a height of about 2H.

While the invention has been described with reference to examples of pistons for use in internal combustion engines where ignition depends entirely upon the generation of a spark, it must be emphasised that it applies also to pistons for internal combustion engines of diesel or other type where ignition either depends entirely upon compression effects, or where such effects are primary but are assisted by a spark.

It is of course within the scope of the invention that the ribs could be seperate from but fixed to the piston rather than integral with and machined from it as shown: also that the ribs could be mounted on a separate disc-like structure which is then fixed to the main body of the piston.

I claim:

1. A piston for use in a cylinder of an internal combustion engine of the class including those engines in which a flame is originated at a point by spark ignition and those in which it is originated by compression ignition, said piston having a piston crown surface and presenting a piston axis along which it is arranged to execute reciprocatory movement, and said cylinder presenting an ignition axis including an imaginary line parallel to said piston axis and passing through the point of said origin of said flame, and comprising:

a piston crown containing said piston crown surface;

a succession of concentric arcuately-aligned obstacles of increasing radius, formed on said piston crown to promote turbulence in an unburned charge as said flame meets the obstacles in succession as it spreads from its point of said origin, each said arcuately-aligned obstacle being radially spaced from one another and in the form of a structure standing proud of said piston crown;

each said structure being interrupted along an arc having a single radius of curvature by which it is aligned, so as to present alternate solid elements and gaps.

2. A piston according to claim 1 in which said solid elements and gaps in one said structure are staggered relative to those in an adjacent said structure.

3. A piston according to claim 1 in which all said gaps have an arc length which is substantially equal.

4. A piston according to claim 1 in which all said solid elements have an arcuate length which is substantially equal.

5. A piston according to claim 1 in which said solid elements are of circular outline, when viewed in a direction normal to that of the spread of said flame.

6. A piston according to claim 1 in which at least said structures of smallest radius constitute complete circles on said piston crown surface.

7. A piston according to claim 1 in which all said solid elements are arranged in a regular geometrical pattern, when viewed in a direction normal to that of the spread of said flame.

8. A piston according to claim 7 in which said regular geometrical pattern is of "diamond" type.

9. A piston according to claim 1 in which said solid elements, when viewed in a direction normal to that of said spread of said flame, are of rectangular outline presenting longer and shorter sides, said longer sides being substantially parallel with said arc with which said structure is aligned.

10. A piston according to claim 9 in which the said rectangular outline of said solid elements is equal in all said structures, and in which said alternate gaps have an arcuate length which is consistent within each arc but increases with increasing arc radius.

11. A piston according to claim 1 in which said piston crown in divided into upper and lower levels by a step, and in which said structures are mounted on both said upper and said lower level.

12. A piston according to claim 11 in which said structures formed on said lower level are taller than those said structures formed on said upper level, so that crests of all of said structures lie substantially in a common radial plane relative to said piston axis.

13. A piston according to claim 11, in which said step, like said structures, is arcuately aligned along an arc having a single radius of curvature, and in which centres of curvature of said arcs of said structures and of said arc of said step are copolanar.

* * * * *

UNITED STATES PATENT AND TRADEMARK OFFICE

CERTIFICATE OF CORRECTION

PATENT NO. : 4,617,888

DATED : October 21, 1986

INVENTOR(S) : John C. DENT

It is certified that error appears in the above-identified patent and that said Letters Patent are hereby corrected as shown below:

The serial number of the above identified patent instead of Serial No. 883,510 should read:

Serial No. 683,510.

Signed and Sealed this

Eleventh Day of August, 1987

*Attest:*

DONALD J. QUIGG

*Attesting Officer*

*Commissioner of Patents and Trademarks*